United States Patent [19]

Elsbery et al.

[11] 3,945,077

[45] Mar. 23, 1976

[54] STRIP CLEANING MECHANISM

[76] Inventors: James W. Elsbery, 42-65 Kissena Blvd., Flushing, N.Y. 11355; Raymond Marshall Smith, Region Drive, Gibsonia, Pa. 15044

[22] Filed: Feb. 3, 1975

[21] Appl. No.: 546,630

[52] U.S. Cl. ..... 15/77; 15/100

[51] Int. Cl.[2] ..... A46B 13/02

[58] Field of Search ..... 15/21 R, 40, 77, 100, 102, 15/306 A; 134/9

[56] References Cited

UNITED STATES PATENTS

| | | | |
|---|---|---|---|
| 1,189,633 | 7/1916 | Shue | 15/100 |
| 1,273,928 | 7/1918 | Rosenfeld | 15/100 X |
| 1,914,890 | 6/1933 | Mackler | 15/100 |
| 1,933,084 | 10/1933 | Allison | 15/100 |

FOREIGN PATENTS OR APPLICATIONS

| | | | |
|---|---|---|---|
| 435,,704 | 9/1935 | United Kingdom | 15/100 |

*Primary Examiner*—Edward L. Roberts

[57] ABSTRACT

A motor drives a film strip take-up reel to draw moving picture film from a freely rotating film supply reel through a film cleaner including a pair of oppositely rotating brushes also driven from said motor. The brushes are disposed on aligned and parallel shafts disposed at a level below that of the supply reel and above that of the take-up reel; with the film following a path generally downwardly from the supply reel about the lower portion of the cleaner brush closest to the film supply reel, up between the cleaner brushes and over the upper portion of the film cleaner brush closest to the film take-up reel, and thereafter generally downwardly onto the film take-up reel. The film path so taken by the film provides for an appropriate tension on the film which in turn insures efficient and proper film cleaning.

10 Claims, 2 Drawing Figures

STRIP CLEANING MECHANISM

BACKGROUND OF THE INVENTION-FIELD OF APPLICATION

This invention relates to strip cleaning mechanisms and more particularly to brush type mechanisms for cleaning strips of reeled material upon which information or data are recorded.

BACKGROUND OF THE INVENTION-DESCRIPTION OF PRIOR ART

Strips of reeled material upon which information or data is recorded may take many forms. It may be mylar or other suitable plastic strip upon which data or information is magnetically encoded; or it may be strips of moving picture film.

The use and or storage of such strips of reeled material quite often results in dust and dirt being deposited upon the strip. During further use the dust or dirt may in turn be deposited upon the magnetic reading or recording heads and thus distort and/or interfere with recording and playback of the encoded information.

Where movie film is involved dust or dirt upon negative film, from which other movie film is to be reproduced, will result in poor and distorted film reporduction. On positive film, which is used for projection of the subject matter which is recorded upon the film, dust and dirt will obscure the picture projected. For either positive or negative film the dust or dirt carried by the film may in turn be deposited upon other mechanisms to interfere with the operation thereof.

Since it is relatively impossible to avoid the deposit of dirt or dust upon the film strip and since it is necessary to obviate the problems created by such dirt or dust various mechanisms have been proposed for removing such dirt or dust from the film strip.

Mechanisms such as those shown in U.S. Pat. No. 2,796,618 for Film Cleaning Device granted to O. E. Arndt on June 25, 1957, and U.S. Pat. 2,987,955 for Apparatus for Treating Motion Picture Film granted to R. Sassenberg on June 13, 1961 have been found unsatisfactory. In these mechanisms the film must pass between cleaning pads urged against opposite surfaces of the film. This action has been found in many instances to scratch the film, and may at times rip or otherwise damage the film. In U.S. Pat. No. 1,189,633 for Motion Picture Film Cleaner granted to E. F. Shue on July 4, 1916 the pad instead of being flat ie is wrapped about a roller but the other aforementioned disadvantages of pad type cleaners still obtain.

Brush type cleaners for film strips have long been available but those of the type shown in U.S. Pat. No. 1,676,299 for Device for Cleaning and Smoothing Films and the like granted to J. J. F. Stock on July 10, 1928 are too complex in construction and operation; while those of the type shown in U.S. Pat. No. 3,239,868 for Film Cleaner granted to P. Di Vito on Mar. 15, 1966 more often than not result in improper cleaning and film damage, due to the action of the brushes moving across the film.

Other film cleaning mechanisms utilizing opposed brushes wiping the film in directions parallel to the direction of film travel are also available. Examples of such mechanisms are shown in U.S. Pat. No. 1,926,981 for Automatic Film Cleaner granted to D. U. Gould, Jr. on Sept. 12, 1933 and U.S. Pat. No. 3,470,576 for Film Cleaning Device granted to D. T. Troia on Oct. 7, 1969. These mechanisms, however, due to their arrangement of cleaning brushes, and the relationship between the cleaning brushes and the path of film travel, have thus far failed to effect efficient film cleaning.

SUMMARY OF THE INVENTION

It is therefore an object of this invention to provide a novel and improved strip cleaning mechanism.

It is another object of this invention to provide a novel and improved film strip cleaning mechanism.

It is still another object of this invention to provide a novel and improved brush type film strip cleaning mechanism.

It is yet still another object of this invention to provide a novel and improved brush type film strip cleaning mechanism which utilizes a pair of opposed cleaning brushes which engage and clean opposite sides of the film strip.

It is yet still a further object of this invention to provide a novel and improved brush type film cleaning mechanism for motion picture film.

This invention involves film supply and take-up reels and opposed and driven cleaning brushes arranged in such a way that the film strip follows a path of travel with respect to the brushes that insures a proper film tension and resultant film cleaning.

In carrying out the invention, according to the preferred embodiment thereof, the film cleaning brushes are arranged aligned and parallel with the film supply reel disposed upwardly and to one side thereof and the film take-up reel disposed downwardly and to the other side thereof. The film path passing from the supply reel beneath and about one cleaning brush, between the cleaning brushes, and about the top of the other cleaning brush to the take-up reel provides the required tension and cleaning action.

Other object, features, and advantages of the invention in its details of construction and arrangement of parts, will be seen from the above, from the following description of the preferred embodiment when considered in conjunction with the drawings, and from the appended claims.

DESCRIPTION OF THE PREFERRED EMBODIMENT

For convenience the invention will be described as applied to a motion picture film strip cleaning mechanism, which is separate and distinct from any mechanism for processing, copying or projecting the film, and wherein the take-up reel and film strip cleaning brushes are motor driven; it being understood, nevertheless, that without departing from the scope of this invention that subject strip cleaning mechanism may be hand driven in addition to or instead of motor driven, may be incorporated as part of a film processing, copying or projecting mechanism, and may be utilized for cleaning strips other than motion picture film.

Figure 1:
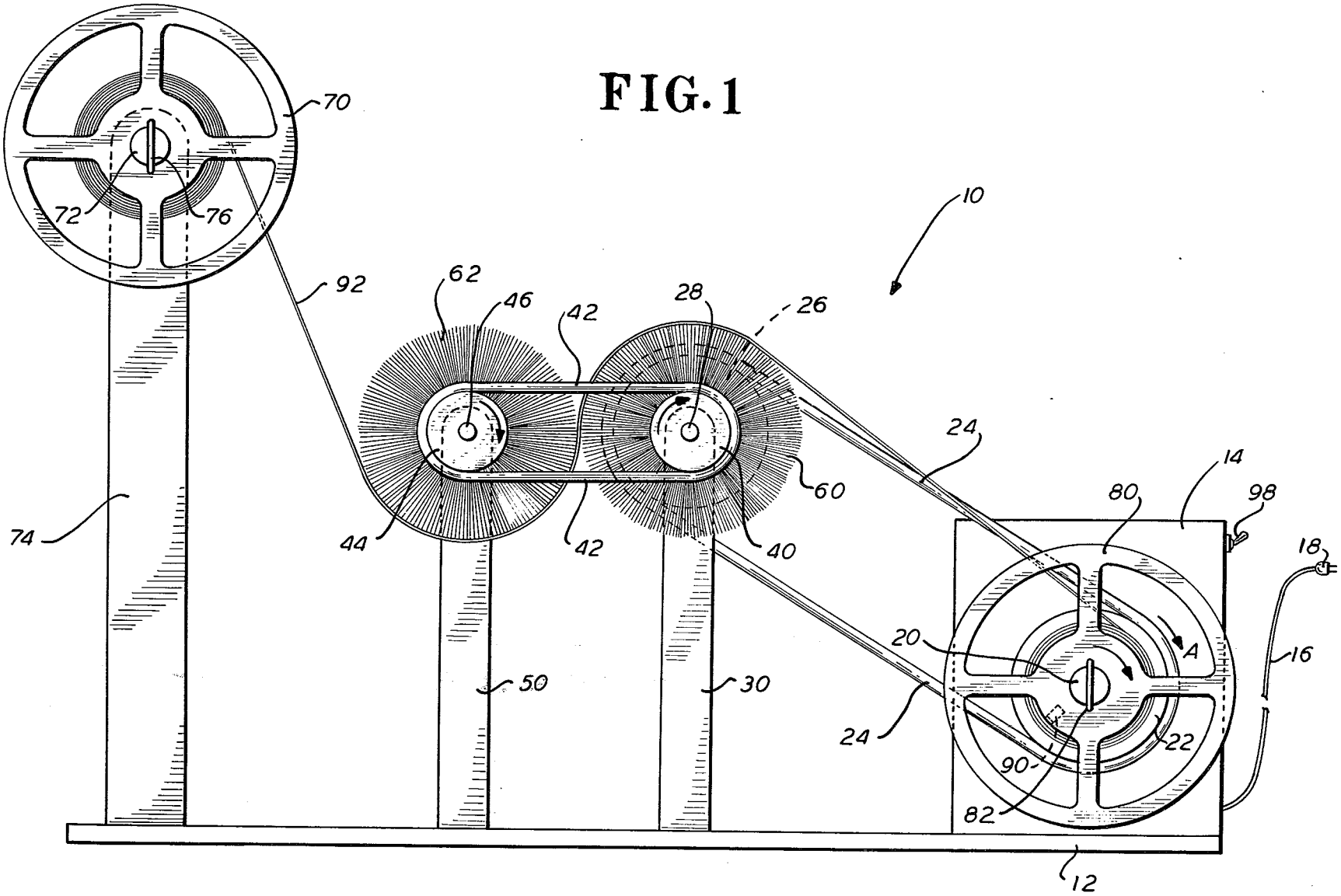
FIG. 1 shows a front elevational view of a strip cleaning mechanism incorporating the instant invention.

With reference to FIG. 1 there is generally shown at 10 a motion picture film strip cleaning mechanism.

Mechanism 10 includes a base plate 12 upon which is securely disposed a motor 14 interconnectable with an appropriate source of electric power (not shown) through a suitable conductor 16 and plug 18.

Figure 2:
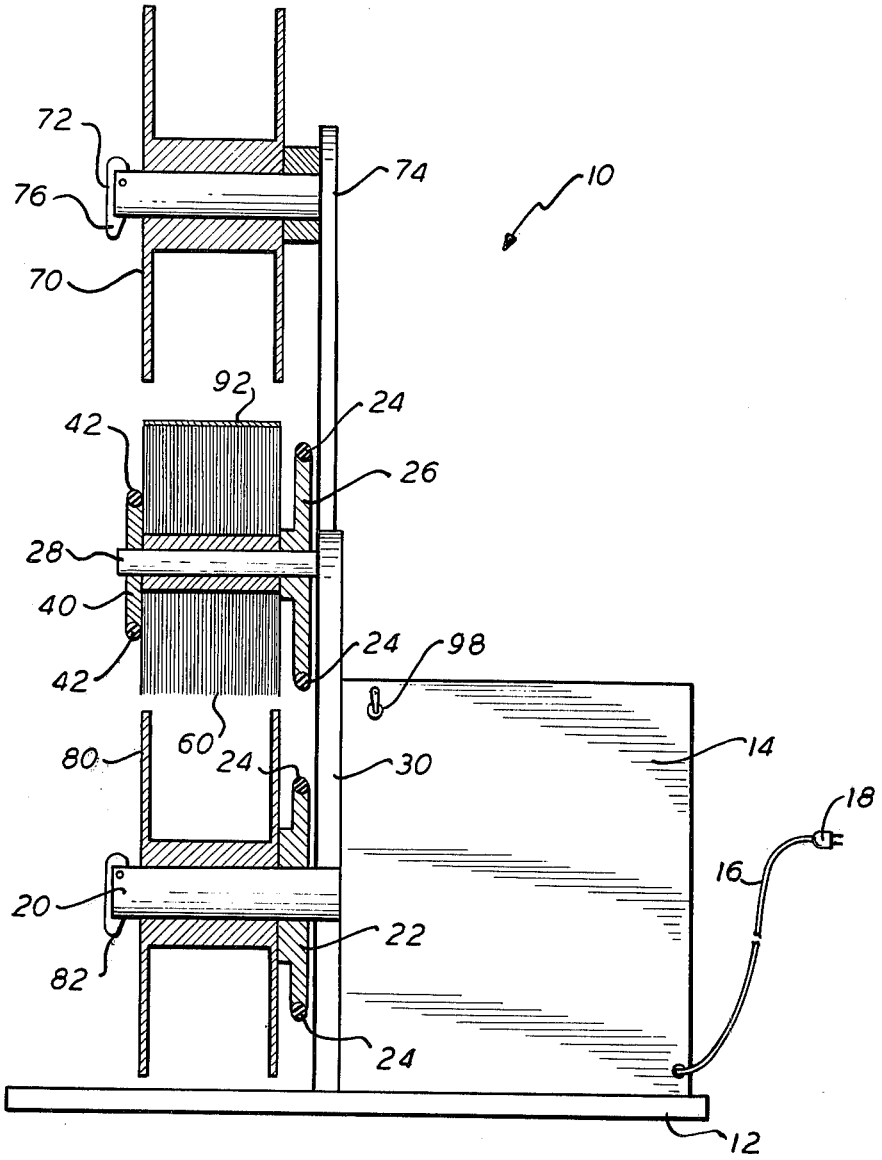
FIG. 2 shows a side elevational view of the film strip cleaning mechanism of FIG. 1, in partial section to better show the details thereof.

A drive shaft 20 (FIGS. 1 and 2) extends out from motor 14 and is driven thereby in the clockwise direction (arrow A) as shown in FIG. 1. Fixedly secured to motor shaft 20 is a drive pulley 22 adapted to drive a drive belt 24. Drive belt 24 in turn drives a driven pulley 26, secured to a brush shaft 28 freely rotatable in suitable bearings (not shown) carried by a support bracket 30 fixedly secured to and rising upwardly from base plate 12.

Also fixedly secured to brush shaft 28 is a brush pulley 40 which drives a brush belt 42. Brush belt 42, in turn, drives a brush pulley 44 (FIG. 1). Brush pulley 44 is fixedly secured to a brush shaft 46 freely rotatable in suitable bearings (not shown) carried by a support bracket 50 fixedly secured to and rising upwardly from base plate 12.

A cleaning brush 60 is fixedly secured to brush shaft 28 for rotation therewith while a cleaning brush 62 is fixedly secured to brush shaft 46 for rotation therewith.

A film supply reel 70 (FIG. 1 and 2), of conventional form, is freely rotatable upon a supply reel shaft 72 fixedly secured to and extending from an upright support bracket 74. Suitable latch means 76 are provided to retain film supply reel 70 on supply reel shaft 72 and to permit removal and replacement thereof.

A film take-up reel 80, of conventional form, is mounted upon motor drive shaft 20 to be driven thereby. Conventionally available means, such as a key and key way combination (not shown) or a set screw (not shown), are provided for this purpose. Appropriate latch means 82 are provided to retain film take-up reel 80 on motor drive shaft 20 and to permit removal and replacement thereof.

A clip 90 is provided and formed to removably attach the end of a strip of motion picture film 92 to film take-up reel 80 to facilitate winding of film 92 thereupon.

In utilizing motion picture film strip cleaning mechanism 10 a reel 70 of motion picture film 92 to be cleaned is placed upon supply reel shaft 72 and latched in place by operation of latch means 76. Supply reel 70 is when so disposed freely rotatable upon supply reel shaft 72. Motion picture film strip 92 is then unreeled and threaded about the lower portion of cleaning brush 62 (as shown in FIG. 1), up between cleaning brushes 62 and 60, over the top of cleaning brush 60 and down about the hub of take-up reel 80. Clip 90 is used to secure film strip 92 to take-up reel 80.

Motor 14 is then activated by operation of on/off switch 98 to drive its shaft 20 and attached pulley 22 and film take-up reel 80 in the clockwise direction (arrow A-FIG. 1). Belt 24 driven by pulley 22 in turn drives pulley 26 in the clockwise direction. This action drives brush shaft 28 and brush 60 in the clockwise direction (FIG. 1) also.

Rotation of brush shaft 28 also drives pulley 40 which, through belt 42, drives pulley 44, brush shaft 46, and cleaning brush 62 in the clockwise direction (FIG. 1) also.

Rotation of take-up reel 80 draws motion picture film strip 92 from supply reel 70 and about and between cleaning brushes 60 and 62. Brushes 60 and 62, driven by the aforementioned action, by their respective coaction with film strip 92 engage and clean opposite surfaces of film strip 92.

The cleaning action of brush 60 and brush 62 upon film strip 92 occurs at adjacent but separate locations. In this manner film strip 92 need only engage one cleaning brush at a time. It is not required to be positioned critically between opposed brushes for simultaneous brushing of opposite sides of the same area as in many prior art film strip cleaning mechanisms.

The disposition of supply reel 70 at a level upwardly with respect to cleaning brushes 60, 62 and of take-up reel 80 downwardly with respect to cleaning brushes 60, 62 and the path taken by film strip 92 creates an appropriate tension upon film strip 92. The appropriate tension in turn insures a proper coaction between cleaning brushes 60, 62 and the surfaces of film strip 92 to provide for proper cleaning of film strip 92.

After the entire film strip 92 is cleaned motor on/off switch 98 is activated to stop motor 14. Film take-up reel 80 is removed from motor shaft 20 and the apparatus is ready to clean the next film strip.

From the above description it will thus be seen that a novel and improved strip cleaning mechanism has been provided for removing dirt and dust from a strip of material such as motion picture film or the like; which mechanism by prescribing a predetermined path for film travel about film strip cleaning brushes insures an appropriate film tension and proper film cleaning.

It is understood that although I have shown the preferred form of my invention that various modifications may be made in the details thereof without departing from the spirit as comprehended by the following claims:

I claim:

1. A strip cleaning mechanism comprising:

a pair of strip cleaning brushes disposed on aligned and parallel brush shafts spaced a distance to accomodate the brushes with their bristles in close proximity to each other;

drive means for rotatably driving said pair of brushes in the same direction;

a strip supply reel rotatably disposed on a supply reel shaft positioned parallel with and to one side of said brush shafts, and at a level which is relatively higher then the level of said brush shafts;

a strip take-up reel disposed on a take-up shaft positioned parallel with and to the other side of said brush shafts and at a level which is relatively lower than the level of said brush shafts;

drive means for driving said take-up reel;

said supply reel, strip cleaning brushes, and take-up reel being arranged to define a strip cleaning path extending relatively downwardly from said supply reel, about the lower portion of one of said cleaning brushes, up between said cleaning brushes, about the upper portion of the other one of said cleaning brushes, and relatively downwardly to said take-up reel; and said strip cleaning path being such that when a film strip extends therethrough from said supply reel, about said brushes, and to said take-up reel that a predetermined tension is applied to the film strip to insure proper contact with said brushes and proper cleaning of the film strip.

2. The strip cleaning mechanism of claim 1 wherein motor means are provided for driving both said take-up reel driving means and said drive means for driving said brushes.

3. The strip cleaning mechanism of claim 2 wherein said motor means directly drives said take-up reel drive means and further includes a pulley and belt drive for transmitting drive power to one of said brush shafts.

4. The strip cleaning mechanism of claim 3 wherein said one of said brush shafts includes a second pulley and said other brush shaft has a pulley thereon and there is a power transmission belt interconnecting said pulleys so that drive power transmitted from said motor to said one brush shaft is in turn transmitted to said other brush shaft.

5. The strip cleaning mechanism of claim 1 wherein said brush shafts and said supply reel shaft are carried by brackets which extend upwardly from a mechanism base plate.

6. The strip cleaning mechanism of claim 1 wherein the brushes coact with the strip when arranged in said strip cleaning path on opposite surfaces thereof.

7. The strip cleaning mechanism of claim 6 wherein the brushes when so coacting with the strip when disposed in said strip cleaning path coact at adjacent locations on opposite surfaces of the strip.

8. The strip cleaning mechanism of claim 1 including clip means for releasably attaching the strip to said take-up reel.

9. The strip cleaning mechanism of claim 1 wherein the strip to be cleaned is motion picture film.

10. The strip cleaning mechanism of claim 1 wherein releasable latch means are provided to facilitate releasable disposition of said supply reel and said take-up reels on their respective shafts.

* * * * *